US006199833B1

(12) United States Patent
Bilby et al.

(10) Patent No.: US 6,199,833 B1
(45) Date of Patent: Mar. 13, 2001

(54) CROWD CONTROL BARRIER

(76) Inventors: Murray Bilby, 134 Pennoak Dr.; Francois Reizine, 556 Long Rd., both of Pittsburgh, PA (US) 15235

( * ) Notice: Subject to any disclaimer, the term of this patent is extended or adjusted under 35 U.S.C. 154(b) by 0 days.

(21) Appl. No.: 09/232,363

(22) Filed: Jan. 15, 1999

(Under 37 CFR 1.47)

(51) Int. Cl.[7] ..... E04H 17/16
(52) U.S. Cl. ..... 256/24; 256/67
(58) Field of Search ..... 256/24, 26, 1, 256/21, 25, 27, 67, 73, DIG. 2

(56) References Cited

U.S. PATENT DOCUMENTS

| | | | | |
|---|---|---|---|---|
| 406,053 | * | 7/1889 | Mishler | 256/27 X |
| 5,402,988 | * | 4/1995 | Eisele | 256/24 |
| 5,863,030 | * | 1/1999 | Kotler et al. | 256/24 |

FOREIGN PATENT DOCUMENTS

| | | | | |
|---|---|---|---|---|
| 444900 | * | 2/1968 | (CH) | 256/24 |
| 2551637 | * | 6/1977 | (DE) | 256/24 |
| 1296138 | * | 5/1962 | (FR) | 256/25 |
| 2503227 | | 4/1981 | (FR) . | |
| 2625238 | * | 6/1989 | (FR) | 256/64 |
| 2063956 | * | 6/1981 | (GB) | 256/24 |

* cited by examiner

*Primary Examiner*—Lynne H. Browne
*Assistant Examiner*—David Bochna
(74) *Attorney, Agent, or Firm*—William F. Lang, IV; David V. Radack; Eckert Seamans Cherin & Mellott, LLC

(57) ABSTRACT

A crowd control barrier including a frame and a base rotatably mounted to the frame and lockable in at least a first position and a second position. The crowd control barrier also includes a pin for securing the base to the frame, the pin being in a first locked position when the base and the frame are locked in the first position, the pin then being rotated into a second locked position so that the base can rotate to the second position, and the pin then being rotated again back to the first locked position when the base and the frame are locked in the second position.

16 Claims, 6 Drawing Sheets

CROWD CONTROL BARRIER

BACKGROUND OF THE INVENTION

The present invention relates generally to crowd control barriers and, more particularly, to a crowd control barrier having a rotatable base that is lockable in different positions.

Crowd control barriers are generally well known and widely used for general crowd control, as well as for other uses. Typical crowd control barriers include a frame having a top rail, a bottom rail, end rails positioned between the top and bottom rails, and a plurality of vertically oriented rails positioned parallel to the end rails and also extending between the top and bottom rails. This type of crowd control barrier also commonly includes a base portion for supporting the frame in an upright position. This type of crowd control barrier is typically constructed of steel, other suitable metal material, or other suitable material for forming a crowd control barrier.

It is known to weld the base to the frame of the crowd control barrier for secure attachment therebetween. However, the base or the frame is frequently damaged during use and one or the other of these components frequently needs to be replaced. Of course, replacement of the base or the frame when these two components are welded together is difficult and expensive. Therefore, the practice of welding the base to the frame was eventually replaced with bolt on bases. Another disadvantage of welding the base to the frame is that the welding usually resulted in a zinc or galvanized protective coating contained on the material from which the crowd control barrier was constructed being damaged and the material beginning to rust. Bolt on bases allowed for easy replacement of the base or the frame without damaging the barrier or effecting the structural integrity of the barrier.

A disadvantage of bolt on bases is that the base typically remained in a fixed position with respect to the frame making transportation and storage of the crowd control barrier difficult. For example, the base typically is positioned perpendicular to the frame and projects outwardly from the frame such that when attempting to stack the barriers for transportation and storage the positioning of the base required additional space for transporting and storing the barriers. Typically, these type of crowd control barriers were placed in an offset stacking arrangement for transportation and storage.

It is known in the art to provide for a crowd control barrier where the base is removably attached to the frame by providing for a pair of aligned apertures that permit the base to be bolted to the frame. Typically, the bolt extends through one of the pair of aligned apertures such that the base is perpendicular to the frame and such that the bolt may be removed and reinserted through the other of the pair of aligned apertures so that the frame and base are aligned. However, the disadvantage of this arrangement is that it is difficult to remove and reinsert the bolt while properly aligning the same with the aligned apertures and, further, such a task typically requires more than one person to carry out the task.

French Patent No. 2,503,227 discloses what appears to be a crowd control barrier having a base that is attached to a frame by a friction fit arrangement such that the base is repositionable with respect to the frame without disconnecting the base from the frame. However, the disadvantage of this arrangement is that once the base is positioned in the desired position with respect to the frame, the base is not securely held in the desired position because of the friction fit arrangement therebetween.

What is needed, therefore, is a crowd control barrier having a frame and a base that is mounted to the frame such that the base may be easily rotated with respect to the frame between at least a use and a storage position and where the base may be locked to the frame in at least the use position and the storage position.

SUMMARY OF THE INVENTION

The crowd control barrier of the invention has met or exceeded the above-mentioned needs as well as others. The crowd control barrier comprises a frame and a base rotatably mounted to the frame and lockable in at least a first position and a second position. The crowd control barrier also comprises a pin for securing the base to the frame, the pin being in a first locked position when the base and frame are locked in the first position, the pin then being rotated into a second locked position so that the base can rotate to the second position, and the pin then being rotated again back to the first locked position when the base and the frame are locked in the second position.

The invention also includes a crowd control barrier comprising a frame, a base mounted to the frame, and means for rotatably locking the base to the frame, the base being rotatable between a first position and a second position and lockable in the first position and the second position.

The invention further includes a crowd control barrier for placement on a surface comprising a frame having a bottom rail and side rail extending from the bottom rail and a base rotatably secured to the bottom rail and rotatable between a first position where the base is in a common plane with the frame and a second position where the base is in a plane that is generally perpendicular to the common plane. The crowd control barrier further comprises the side rail including an outer limit point in the common plane which is on a line that is generally perpendicular to the surface, the base having no portion extending beyond the line.

BRIEF DESCRIPTION OF THE DRAWINGS

A full understanding of the invention can be gained from the following detailed description of the invention when read in conjunction with the accompanying drawings in which.

DETAILED DESCRIPTION

Figure 1:
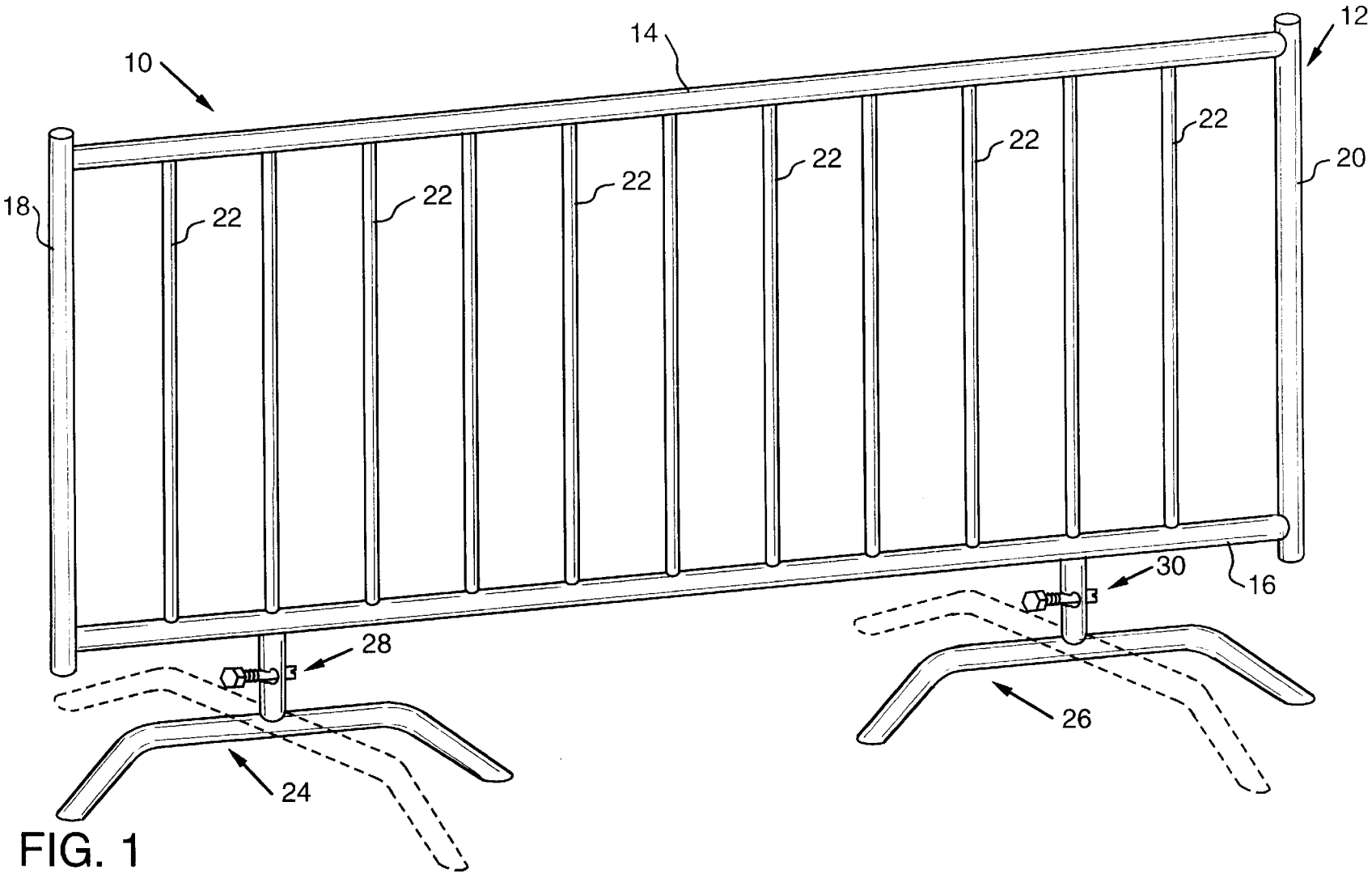
FIG. 1 is an isometric view of a preferred embodiment of the invention.

Referring now to FIGS. 1–12, a preferred embodiment of the crowd control barrier 10 of the invention is shown. The crowd control barrier 10 includes a frame, generally designated by the reference numeral 12 having a top rail 14, a bottom rail 16, end rails 18 and 20 positioned between the top rail 14 and bottom rail 16, and a plurality of vertically oriented rails 22 positioned parallel to the end rails 18 and 20 and also extending between the top rail 14 and the bottom rail 16. The crowd control barrier 10 also includes one or more bases 24 and 26 that are rotatably mounted to the frame 12, as will be explained in detail herein.

As shown in FIG. 1, the bases 24 and 26 are lockable in at least a first position where the bases 24 and 26 are in a common plane with the frame 12 (solid line) and second position where the bases 24 and 26 are in a plane that is generally perpendicular to the common plane (phantom line). Pins 28 and 30 are provided for rotatably locking the bases 24 and 26, respectively, to the frame 12. As will be described in detail herein, the pins 28 and 30 are rotatable between a first locked position (FIG. 7) for locking the bases 24 and 26 to the frame 12 in the first position and a second position, and a second locked position for rotating the bases 24 and 26 between the first position and the second position. Advantageously, this provides for the crowd control barrier 10 to have a frame 12 and bases 24 and 26 that are mounted to the frame 12 such that the bases 24 and 26 may be easily rotated with respect to the frame 12 between the first position and the second position and where the bases 24 and 26 may be locked to the frame 12 in the first position and the second position. As can be appreciated, the first position, where the bases 24 and 26 are in a common plane with the frame 12, allows for easy storage and transportation of the crowd control barrier 10 where, for example, several crowd control barriers may be easily stacked or pallatized on top of one another. Then, once the crowd control barrier 10 is ready for use, the bases 24 and 26 may be easily rotated to the second position and locked in the second position for placement of the crowd control barrier 10 in an upright position. Of course, it will be appreciated that while for purposes of illustration the crowd control barrier 10 includes bases 24 and 26 that are positionable in a first position and a second position, other positions for placement of the bases 24 and 26 may also be provided if needed.

Figure 2:
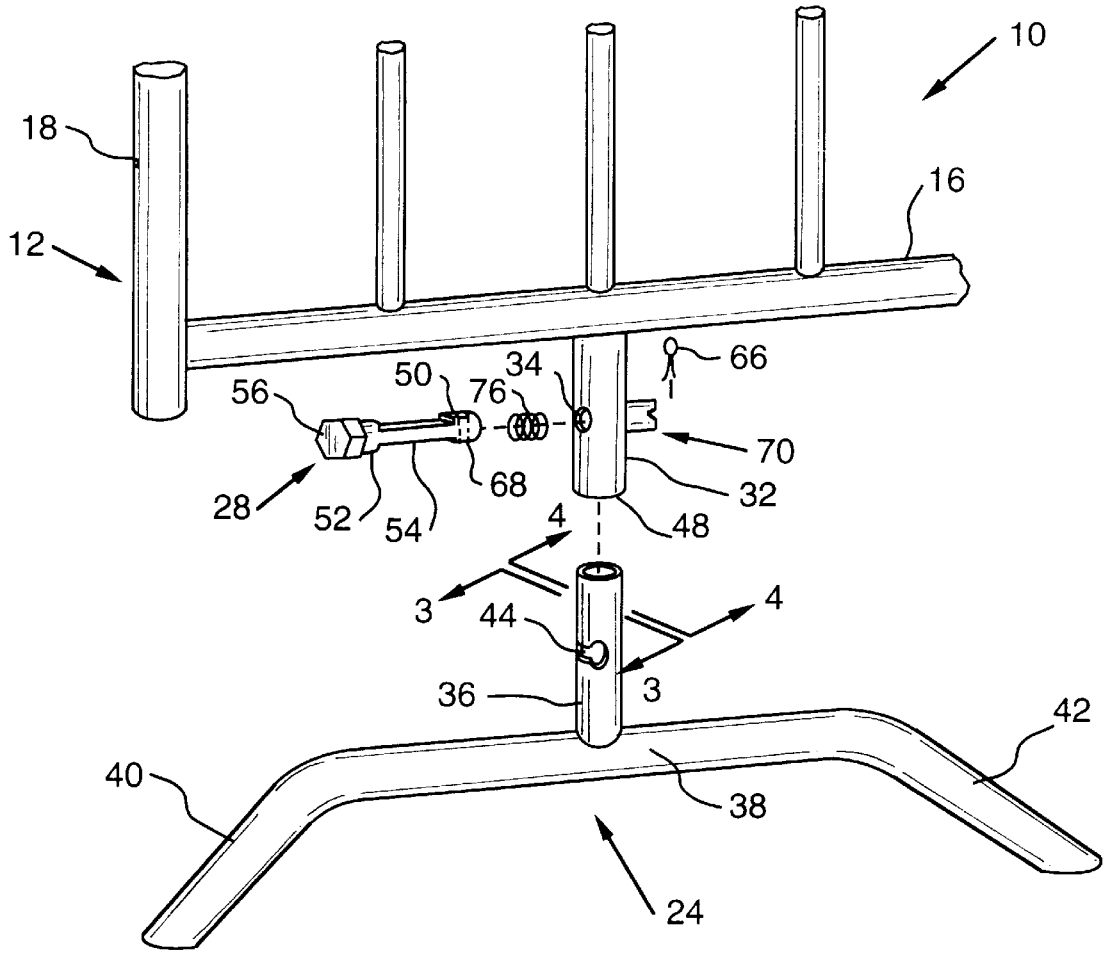
FIG. 2 is a partial, exploded isometric view of the inventions

Referring to FIG. 2, the mounting of the base 24 to the frame 12 will be described in more detail. It will be understood that the mounting of the other base 26 to the frame 12 is essentially identical and, therefore, will not be repeated herein. The bottom rail 16 of frame 12 includes a generally downwardly depending sleeve 32 extending therefrom. The sleeve 32 defines a pair of aligned apertures 34 (only one aperture shown) The base 24 includes a generally upwardly depending post 36 extending from a horizontal member 38 of the base 24. The horizontal member 38 includes legs 40 and 42 on opposing ends thereof for contacting a surface and supporting the crowd control barrier 10. The post 36 defines a pair of opposing elongated slots 44 and 46 (see FIGS. 3 and 4). The sleeve 32 includes an opening 48 for receiving the post 36 of the base 24. The post 36 is positioned within the sleeve 32 such that a portion of the opposing elongated slots 44 and 46 are aligned with the apertures 34. The pin 28, which as stated provides a means for rotatably locking the base 24 to the frame 12, extends through the aligned apertures 34 and the elongated slots 44 and 46.

Referring to FIGS. 2, 5, 5*a*, 6 and 6*a*, the pin 28 includes a first end portion 50, a second end portion 52, an intermediate portion 54, and a head 56 affixed to the second end portion 52. The intermediate portion 54 of pin 28 is formed so as to have an arcuate shape on opposing ends 58 and 60 and to have generally flat surfaces formed on opposing sides 62 and 64. This particular shape of the pin 28 facilitates receipt of the pin 28, and in particular the intermediate portion 54 thereof, within the opposing elongated slots 44 and 46, as will be explained in more detail herein.

Figure 5:
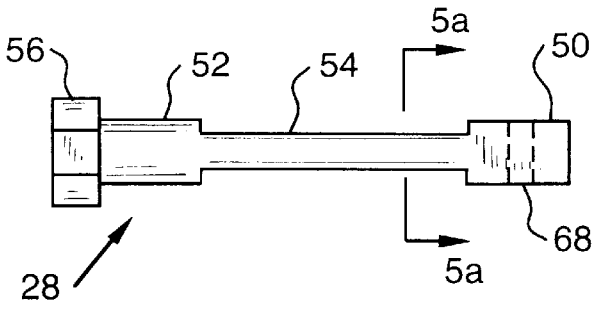
FIG. 5 is a top view of a pin for securing a base to a frame of a crowd control barrier of the invention.
Figure 5A:
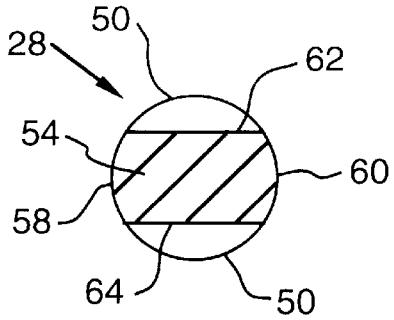
FIG. 5*a* is a sectional view taken along line 5*a*—5*a* of FIG. 5.
Figure 6:
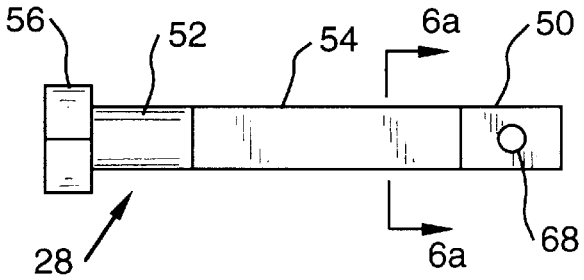
FIG. 6 is a side view of the pin shown in FIG. 5.
Figure 6A:
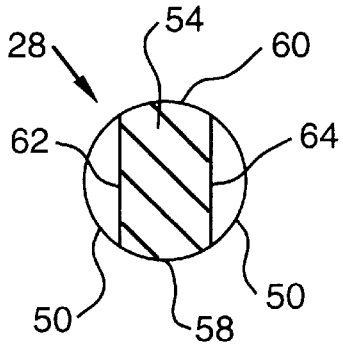
FIG. 6*a* is a sectional view taken along line 6*a*—6*a* of FIG. 6.
Figure 7:
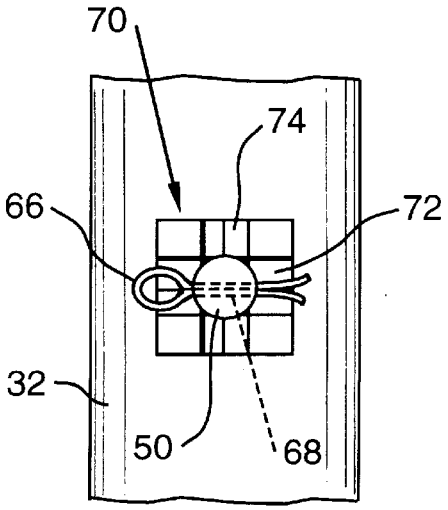
FIG. 7 shows the pin of FIGS. 5 and 6 in a first locked position.

The pin 28 is rotatable between a first locked position (FIGS. 6 and 6*a*) and a second locked position (FIGS. 5 and 5*a*). While in the first locked position, the pin 28 locks the base 24 to the frame 12 in either the first position or the second position. While in the second locked position, the pin 28 allows for the base 24 to be rotated between the first position and the second position.

Figure 8:
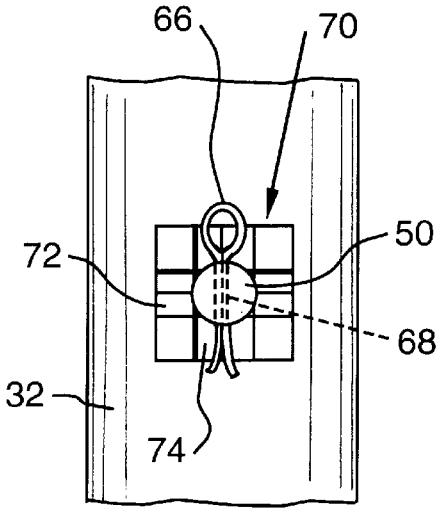
FIG. 8 is similar to FIG. 7 only showing the pin in a second locked position.

Referring to FIGS. 2 and 5–8, retaining means are provided for retaining the pin 28 in one of the first locked position or the second locked position. Specifically, the retaining means includes a retaining member, such as a cotter pin 66 which is removably received within a bore 68 extending through the first end portion 50 of the pin 28. The retaining means also includes a locking member 70 connected to the sleeve 32, such as by welding or other means generally known in the art, and operatively associated with the pin 28 adjacent one of the aligned apertures 34 of the sleeve 32. Generally, the locking member 70 receives the cotter pin 66 in a first receiving position when the pin 28 is in the first locked position (FIG. 7) and in a second receiving position when the pin 28 is in the second locked position (FIG. 8). Specifically, the locking member 70 includes a first retaining groove 72 for receiving the cotter pin 66 when the cotter pin 66 is in the first receiving position and a second retaining groove 74 for receiving the cotter pin 66 when in the second receiving position. Preferably, the first retaining groove 72 and the second retaining groove 74 are V-shaped, but may be of any other suitable shape for receiving the cotter pin 66 or similar type pin which may serve as the retaining member. The cotter pin 66 is suitable for use with the invention because it is removably attached to the pin 28 allowing for the pin 28 to be completely removed and the base 24 to be separated from the frame 12. Preferably, the first retaining groove 72 is generally perpendicular to the second retaining groove 74.

Figure 9:
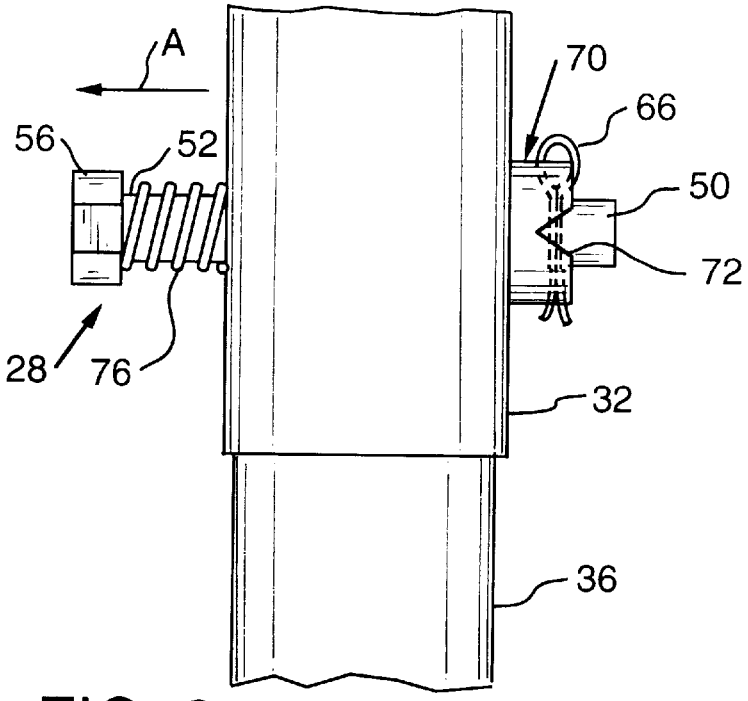
FIG. 9 also illustrates the pin in the second locked position.
Figure 10:
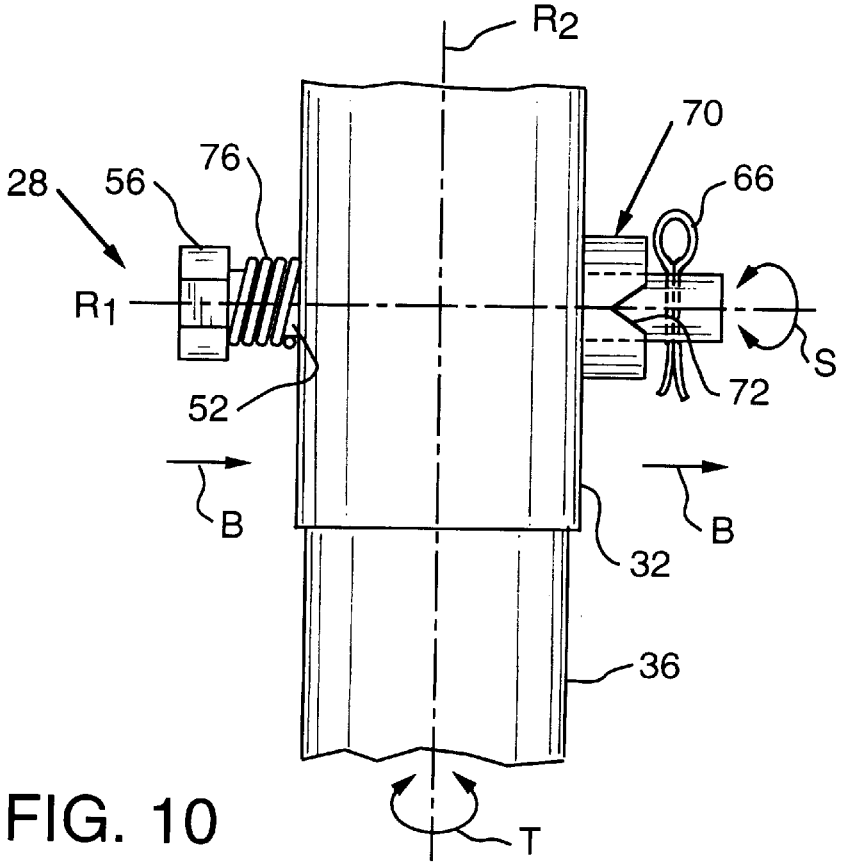
FIG. 10 is a view similar to FIG. 9 only showing the fin following compression thereof so that the pin may be rotated between the second locked position and the first locked position.

Referring to FIGS. 9 and 10, the retaining means further includes a biasing means, such as spring 76, positioned adjacent the second end portion 52 of the pin 28 for biasing the cotter pin 66 into one of the first retaining groove 72 or the second retaining groove 74. In FIG. 9, the cotter pin 66 is positioned in the second retaining groove 74, which is not visible in this figure. Preferably, the spring 76 is circumferentially disposed about the second end portion 52 of the pin 28 and positioned between the head 56 of the pin 28 and the sleeve 32 of the frame 12 for biasing the pin in the direction of arrow A, as shown in FIG. 9. The biasing action provided by the spring 76 maintains the cotter pin 66 in either the first retaining groove 72 or the second retaining groove 74. As shown in FIG. 10, depression of the head 56 of pin 28 in the direction of arrow B, results in compression of the spring 76 and the cotter pin 66 being removed from the second retaining groove 74 when the pin 28 is in the second locked position. Similarly, when the pin 28 is in the first locked position, depression of the head 56 of pin 28 also results in the compression of the spring 76 and the cotter pin 66 being removed from the first retaining groove 72. Once the cotter pin 66 is removed from either the first retaining groove 72 or the second retaining groove 74, the pin 28 may be rotated to the desired position. Once the head 56 of pin 28 is no longer depressed, the biasing action provided by spring 76 results in the cotter pin being once again received in either the first retaining groove 72 or the second retaining groove 74.

As also shown in FIG. 10, the pin 28 rotates about a first axis of rotation R1, and as illustrated by arrow S, where the axis of rotation R1 extends generally longitudinally through the pin 28. The base 24 rotates with respect to the frame 12 about a second axis of rotation R2, and as illustrated by arrow T, where the second axis of rotation R2 extends generally longitudinally through the post 36 of the base 24 and the sleeve 32 of the frame 12. Preferably, the first axis of rotation R1 is generally perpendicular to the second axis of rotation R2. This allows for smooth and efficient rotation of the base 24 with respect to the frame 12 so that the base 24 may be placed in the first position or the second position.

Figure 3:
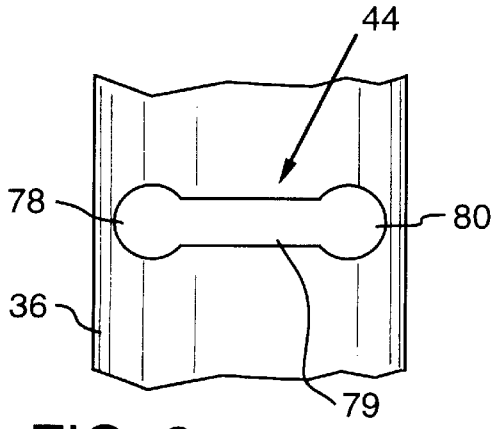
FIG. 3 is a sectional view taken along line 3—3 of FIG. 2.
Figure 4:
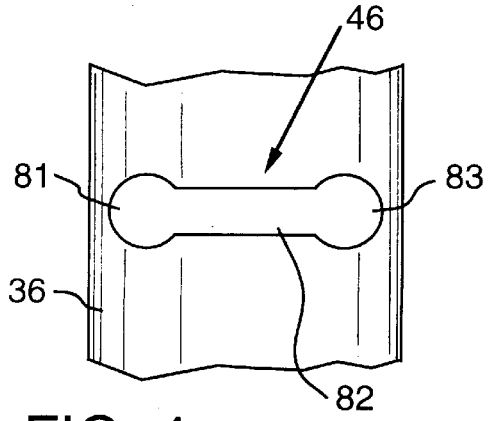
FIG. 4 is a sectional view taken along line 4—4 of FIG. 2.
Figure 11:
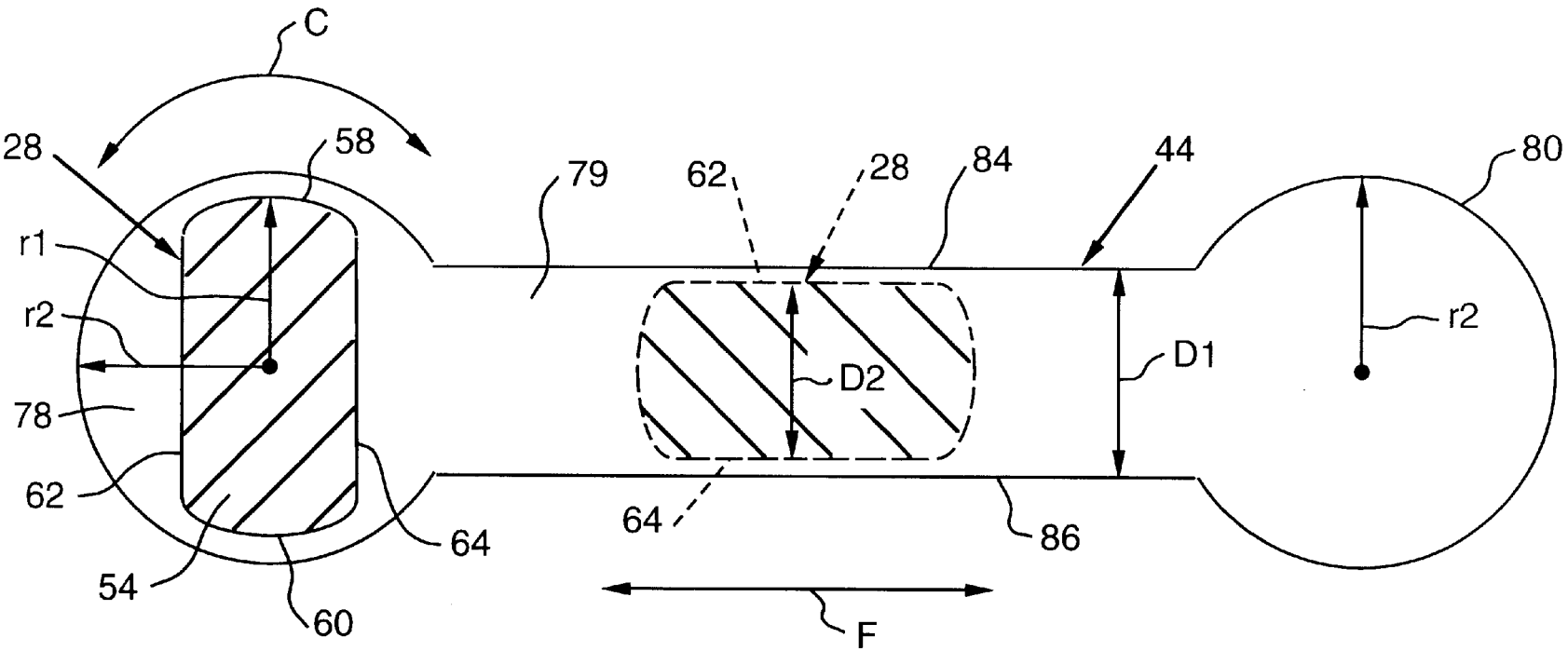
FIG. 11 is a partial sectional view showing the cooperation between the pin and the opposing elongated slot shown in FIG. 3.

Referring to FIGS. 3–4 and 11, the slot 44 includes a first opening 78, a second opening 79 and a third opening 80. Similarly, the slot 46 includes a first opening 81, a second opening 82 and a third opening 83. Generally, the slot 44 and slot 46 are constructed and arranged such that the base 24 is locked in one of the first position and the second position when the pin 28 is in the first locked position, and the slot 44 and slot 46 are also constructed and arranged such that the base 24 can be rotated between the first position and the second position when the pin 28 is in the second locked position. The pin 28, and particularly the intermediate portion 54 thereof, is structured for receipt in one of the first openings 78 and 81 and the third openings 80 and 83 when the pin 28 is in the first locked position. The pin 28, and particularly the intermediate portion 54 thereof, is structured for receipt in one of the first openings 78 and 81, the second openings 79 and 82, and the third openings 80 and 83 when the pin 28 is in the second locked position.

Referring specifically to FIG. 11 the operation of pin 28 with respect to the slot 44 will be explained in more detail. The pin 28 is shown in solid line as received in the first opening 78 of the slot 44, while the pin 28 is shown in phantom line as received in the second opening 79 of the slot 44. The intermediate portion 54 of the pin 28 is shown as received in the slot 44 where the intermediate portion 54 is constructed such that when the pin 28 is in the first locked position (solid line) the intermediate portion 54 is resisted from being received in the second opening 79 of the slot 44. When the pin 28 is in the second locked position (phantom line) the intermediate portion 54 can move freely within the second opening 79 of the slot 44. The pin 28 is rotatable within the first opening 78, as well as the third opening 80 of the slot 44, as shown by arrow C, when the cotter pin 66 is removed from the first retaining groove 72 and as a result of the arcuate opposing ends 58 and 60 of the pin 28 having a first radius r1 and the generally circular first opening 78 and third opening 80 having a second radius r2 where the radius r2 is larger than the radius r1.

In addition, movement of the pin 28 within the second opening 79 of the slot 44 results from the second opening 79 having a top surface 84 and a bottom surface 86 spaced apart a first distance D1 and the opposing generally flat surfaces 62 and 64 of the pin 28 being spaced apart a second distance D2 where the first distance D1 is greater than the second distance D2. This allows for the pin 28 to move freely within the second opening 79 between the first opening 78 and the third opening 80. By locking the pin 28 in the second locked position (see FIG. 8) the pin 28 is allowed to move freely within the second opening 79 of the slot 44 without binding occurring between the pin 28 and the top surface 84 and the bottom surface 86 of the second opening 79. This allows for the pin 28 to move generally back and forth in the direction of arrow F while in the second opening 79. It will be appreciated that movement of the pin 28 with respect to the other slot 46 is essentially the same as described herein for slot 44. In addition, it will also be appreciated that other configurations for the slots and pin received therein may be provided in accordance with the invention.

Figure 12:
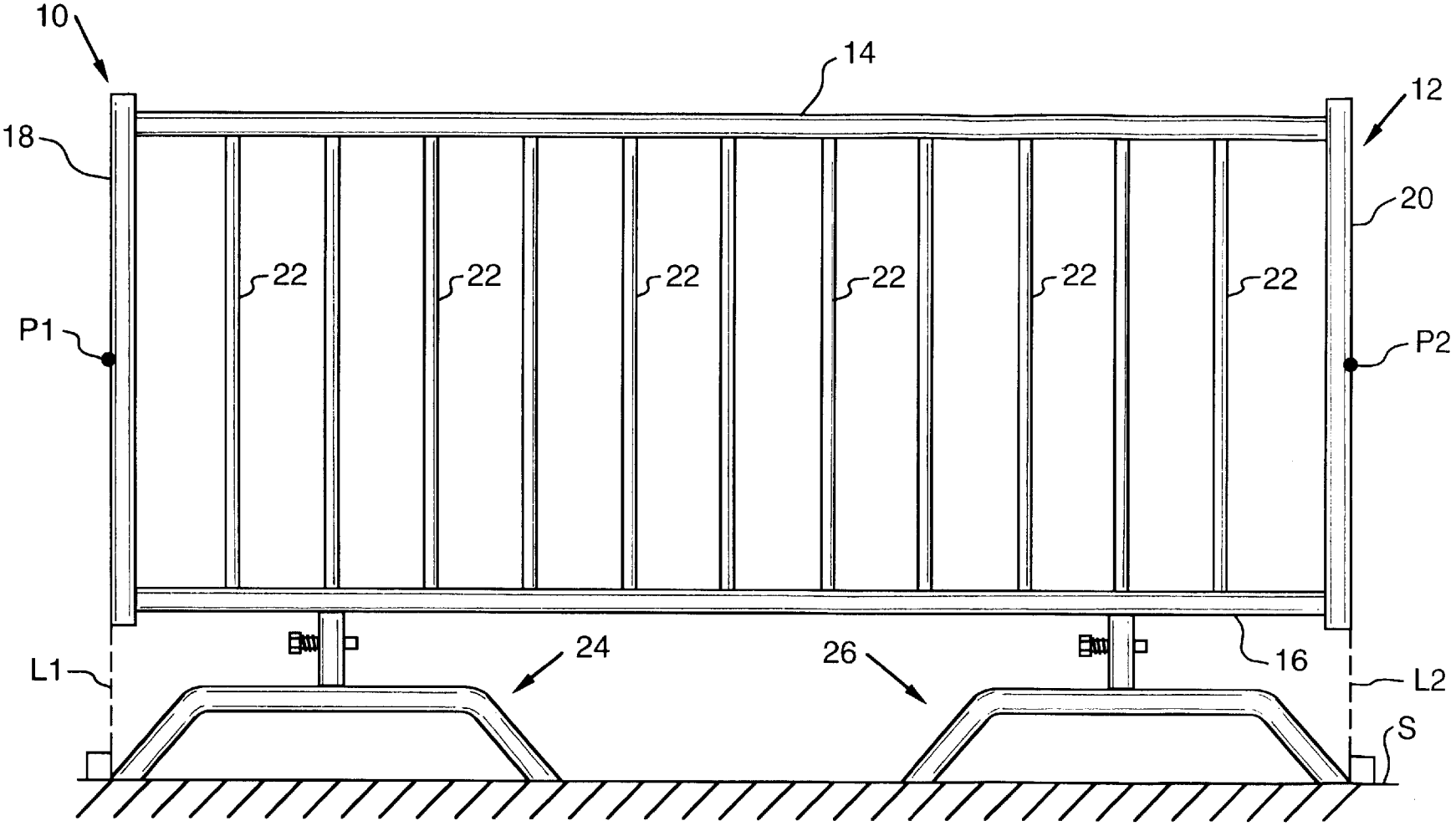
FIG. 12 is an elevational view of the invention shown in FIG. 1.

Referring to FIG. 12, the crowd control barrier 10 is shown as placed on a surface S. The end rail 18 includes an outer limit point P1 contained in the common plane with the frame 12 and the base 24 and base 26. Similarly, the end rail 20 includes an outer limit point P2. The outer limit point P1 is contained on a line L1 that is generally perpendicular to the surface S. Similarly, the outer limit point P2 is contained on a second line L2 that is also generally perpendicular to the surface S. In order to allow for easy storage and transporting of the crowd control barrier 10, no portion of the base 24 extends beyond the line L1, and no portion of the base 26 extends beyond the line L2. This is particularly advantageous when the base 24 and the base 26 is contained in the common plane with the frame 12.

In the embodiment of the crowd control barrier 10 shown in FIG. 12, the end rails 18 and 20 are preferably generally perpendicular to the bottom rail 16 and the bottom rail 16 is preferably generally parallel to the surface S. In addition, the line L1 is preferably coextensive with the end rail 18 and the line L2 is preferably coextensive with the end rail 20. However, it should be appreciated that end rails having a different configuration may be provided wherein the particular end rail would still include an outer limit point contained in a line where the base portion would not extend beyond the line.

It will be appreciated that a crowd control barrier has been disclosed having a frame and a base that is mounted to the frame such that the base may be easily rotated with respect to the frame between at least a first position and a second position for storage and use, respectively, and where the base may be locked to the frame in at least the first position and the second position. When the base is in the first position, the base is in a common plane with the frame. Advantageously, this allows for the crowd control barrier to be easily stored and transported. More particularly, a plurality of crowd control barriers may be placed one on top of the other for convenient storage and transportation.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A crowd control barrier comprising:

a frame;

a base mounted to said frame;

means for rotatably locking said base to said frame, said base being rotatable between a first position and a second position and lockable in said first position and said second position;

said frame includes a generally downwardly depending sleeve, said sleeve defining a pair of aligned apertures;

said base includes a generally upwardly depending post that is received in said sleeve, said generally upwardly depending post defining a pair of opposing elongated slots; and said means for rotatably locking said base to said frame includes a pin extending through said aligned apertures and said opposing elongated slots.

2. The crowd control barrier of claim 1 wherein:

said pin is rotatable between a first locked position for locking said base to said frame in one of said first position and said second position and a second locked position for rotating said base between said first position and said second position.

3. The crowd control barrier of claim 2 wherein:

said means for rotatably locking said base to said frame further includes retaining means for retaining said pin in one of said first locked position and said second locked position.

4. The crowd control barrier of claim 3 wherein:

said pin includes a first end portion and a second end portion opposite said first end portion;

said retaining means including a retaining member disposed on said first end portion of said pin; and said retaining means further including a locking member operatively associated with said pin adjacent one of said aligned apertures of said sleeve, said locking member receiving said retaining member in a first receiving position when said pin is in said first locked position and said locking member receiving said retaining member in a second receiving position when said pin is in said second locked position.

5. The crowd control barrier of claim 4 wherein:

said opposing elongated slots are constructed and arranged such that said base is locked in one of said first position and said second position when said pin is in said first locked position; and said opposing elongated slots are constructed and arranged such that said base can be rotated between said first position and said second position when said pin is in said second locked position.

6. The crowd control barrier of claim 5 wherein:

each said opposing elongated slot defines a first opening, a second opening and a third opening;

said pin being structured for receipt in one of said first opening and said third opening when said pin is in said first locked position; and said pin is structured for receipt in one of said first opening, said second opening and said third opening when said pin is in said second locked position.

7. The crowd control barrier of claim 6 wherein:

said pin includes an intermediate portion which is received in said opposing elongated slots, said intermediate portion being constructed such that when said pin is in said first locked position said intermediate portion is resisted from being received in said second opening of said opposing elongated slots, and when said pin is in said second locked position said intermediate portion can move freely within said second opening of said opposing elongated slots.

8. The crowd control barrier of claim 7 wherein:

said locking member includes a first retaining groove for receiving said retaining member when said retaining member is in said first receiving position and a second retaining groove for receiving said retaining member when in said second receiving position.

9. The crowd control barrier of claim 8 wherein:

said first retaining groove is generally perpendicular to said second retaining groove.

10. The crowd control barrier of claim 9 wherein:

said retaining member is removably attached to said pin.

11. The crowd control barrier of claim 8 wherein:

said retaining means further includes a biasing means positioned adjacent said second end portion of said pin for biasing said retaining member into one of said first retaining groove and said second retaining groove.

12. The crowd control barrier of claim 11 wherein:

said biasing means is a spring.

13. The crowd control barrier of claim 12 wherein:

said pin further includes a head formed adjacent said second end portion of said pin;

said spring being circumferentially disposed about said second end portion of said pin and being positioned between said head and said sleeve of said frame, such that depression of said head results in compression of said spring and said retaining member being removed from said first retaining groove when said pin is in said first locked position and from said second retaining groove when said pin is in said second locked position.

14. The crowd control barrier of claim 8 wherein:

said intermediate portion of said pin has a cross section that is generally arcuate on opposing ends of said intermediate portion and has generally flat surfaces formed on opposing sides of said intermediate portion, said generally arcuate opposing ends having a first radius.

15. The crowd control barrier of claim 14 wherein:

said first opening and said third opening of said opposing elongated slots are generally circular and have a second radius that is larger than said first radius.

16. The crowd control barrier of claim 15 wherein:

said second opening of said opposing elongated slots has a top and a bottom spaced apart a first distance;

said generally flat surfaces formed on opposing sides of said intermediate portion are spaced apart a second distance; and said first distance being greater than said second distance.

* * * * *

UNITED STATES PATENT AND TRADEMARK OFFICE

CERTIFICATE OF CORRECTION

PATENT NO. : 6,199,833 B1
DATED : March 13, 2001
INVENTOR(S) : Murray Bilby et al.

It is certified that error appears in the above-identified patent and that said Letters Patent is hereby corrected as shown below:

Column 2,
Line 45, "inventions" should read -- invention; --.
Line 64, "fin" should read -- pin --.

Signed and Sealed this

Nineteenth Day of March, 2002

*Attest:*

*Attesting Officer*

JAMES E. ROGAN
*Director of the United States Patent and Trademark Office*